US012459717B2

(12) United States Patent
Searle

(10) Patent No.: US 12,459,717 B2
(45) Date of Patent: Nov. 4, 2025

(54) CONTAINER FOR TRANSPORTING EQUIPMENT FOR SPACE-RELATED APPLICATIONS

(71) Applicant: GSTC LLC, Scottsdale, AZ (US)

(72) Inventor: Gideon P. Searle, Scottsdale, AZ (US)

(73) Assignee: GSTC LLC, Scottsdale, AZ (US)

( * ) Notice: Subject to any disclaimer, the term of this patent is extended or adjusted under 35 U.S.C. 154(b) by 249 days.

(21) Appl. No.: 18/068,222

(22) Filed: Dec. 19, 2022

(65) Prior Publication Data

US 2023/0192382 A1 Jun. 22, 2023

Related U.S. Application Data

(60) Provisional application No. 63/292,183, filed on Dec. 21, 2021.

(51) Int. Cl.
*B65D 81/05* (2006.01)
*B65D 81/07* (2006.01)
*B65D 85/68* (2006.01)

(52) U.S. Cl.
CPC ..... *B65D 81/052* (2013.01); *B65D 81/07* (2013.01); *B65D 85/68* (2013.01)

(58) Field of Classification Search
CPC .. B65D 81/052; B65D 81/07; B65D 81/1075; B65D 85/68; B64G 5/00
USPC ... 206/3, 205, 278, 305, 317, 493, 509, 516, 206/521–522, 524.8, 570, 583–584, 592, 206/594, 711; 220/23.5, 305, 315, 320, 220/560.12, 565, 590, 592.27, 6, 675, 1.5, 220/62.21, 495.06; 224/625, 645; 264/10, 258; 383/3; 53/472, 139.5
See application file for complete search history.

(56) References Cited

U.S. PATENT DOCUMENTS 2,524,413 A * 10/1950 Von Migula ..... B25H 1/0007 248/556
2,615,707 A * 10/1952 Rowe ..... F16F 15/067 217/54
2,681,142 A * 6/1954 Cohen ..... B65D 45/30 206/583
3,044,161 A * 7/1962 Morrison ..... F25D 23/063 29/445
3,389,534 A * 6/1968 Pendleton ..... B31D 5/0078 53/550
3,462,007 A * 8/1969 Heider ..... B65D 81/09 428/313.5

(Continued)

*Primary Examiner* — Orlando E Aviles
*Assistant Examiner* — Brijesh V. Patel
(74) *Attorney, Agent, or Firm* — NEO IP

(57) ABSTRACT

A container for transporting satellite equipment and other equipment into low-orbit and deep space includes vacuum rigidizing structures covering the interior of each side wall and base of the container. The vacuum rigidizing structures contain microbeads and is connected to a pump mechanism able to transfer air into or out of the vacuum rigidizing structures. Before the equipment is added to the container, air is released from the vacuum rigidizing structures. After the equipment is added, the vacuum rigidizing structures are able to be inflated enough such that the microbeads compactly conform around the equipment, preventing movement while applying minimal pressure to the equipment. The container is capped with a lid lined with aerospace-grade foam.

11 Claims, 7 Drawing Sheets

(56) References Cited

U.S. PATENT DOCUMENTS 3,656,649 A * 4/1972 Martin ..... B65D 85/38 248/184.1
3,667,593 A * 6/1972 Pendleton ..... B29C 66/83413 53/472
3,823,903 A * 7/1974 Kendall ..... F41F 3/052 248/563
3,844,203 A * 10/1974 Takahashi ..... B65D 90/0066 220/592.2
4,013,170 A * 3/1977 Hutterer ..... B65D 81/07 206/583
4,262,801 A * 4/1981 Avery ..... B65D 81/075 383/3
4,491,225 A * 1/1985 Baillod ..... B65D 81/075 206/583
4,574,955 A * 3/1986 Camossi ..... B65D 81/07 206/583
4,640,080 A * 2/1987 Wright ..... B65D 81/09 53/472
4,664,254 A * 5/1987 Sitwell ..... B65D 81/24 206/583
4,874,093 A * 10/1989 Pharo ..... B65D 81/03 206/592
4,880,119 A * 11/1989 Simon ..... B65D 81/09 206/584
4,919,300 A * 4/1990 Anderson ..... B65D 81/00 206/583
5,217,131 A * 6/1993 Andrews ..... B65D 81/052 383/3
5,232,095 A * 8/1993 Childers ..... B65D 81/07 206/583
5,232,184 A * 8/1993 Reuter ..... B64D 17/64 244/148
5,287,969 A * 2/1994 Kehr ..... B65D 81/02 206/583
5,316,149 A * 5/1994 Tate ..... B65D 81/09 53/472
5,351,830 A * 10/1994 Bender ..... B65D 81/051 206/592
5,487,470 A * 1/1996 Pharo ..... B65D 81/052 206/521
5,573,119 A * 11/1996 Luray ..... A43D 100/00 206/583
5,655,662 A * 8/1997 Garcia ..... B65D 7/24 206/583
5,769,232 A * 6/1998 Cash ..... B65D 81/052 383/3
5,788,078 A * 8/1998 Fuss ..... B65H 35/0006 206/521
5,823,348 A * 10/1998 Phillips ..... B65D 81/07 206/583
6,128,889 A * 10/2000 Fuss ..... B31D 5/0078 53/472
6,135,277 A 10/2000 Armstrong
6,202,849 B1 * 3/2001 Graham ..... B65D 25/16 206/524.8
6,286,386 B1 * 9/2001 Spletzer ..... B62D 57/00 180/8.5
6,341,708 B1 * 1/2002 Palley ..... B65D 88/14 229/122.34
6,490,880 B1 * 12/2002 Walsh ..... F25D 3/08 62/371
6,510,946 B2 * 1/2003 Gutierrez ..... A45C 11/20 206/524.8
6,802,931 B2 * 10/2004 Fujihira ..... B29C 70/342 264/258
7,516,597 B1 * 4/2009 Roose ..... B65B 55/20 53/139.5
7,669,727 B2 * 3/2010 Hubbard ..... B65D 77/06 220/9.4
7,828,146 B2 * 11/2010 Frayne ..... B65D 81/052 137/511
8,413,833 B1 * 4/2013 Taylor ..... H05K 5/061 220/675
8,875,937 B2 * 11/2014 Hay ..... B65F 1/122 220/675
9,303,950 B2 4/2016 Fuller
9,429,389 B1 8/2016 Brewer
9,738,429 B2 * 8/2017 Buelna ..... B65D 81/07
9,803,956 B2 10/2017 Ellingson
9,955,763 B2 5/2018 McLean et al.
10,082,189 B2 * 9/2018 Kronkright ..... B65D 81/07
10,252,833 B2 * 4/2019 Hao ..... B65D 25/10
10,532,870 B2 * 1/2020 Baud ..... A61J 1/05
11,220,363 B2 * 1/2022 Konig ..... B65D 77/04
11,332,296 B2 * 5/2022 Roesler ..... A61B 17/865
2003/0006162 A1 * 1/2003 Smith ..... B65D 81/027 206/583
2005/0194285 A1 * 9/2005 Peterse ..... B65D 81/052 206/522
2006/0102514 A1 * 5/2006 Cognard ..... B65D 81/00 206/583
2006/0144745 A1 * 7/2006 Abe ..... B65D 81/052 206/522
2006/0219723 A1 * 10/2006 Wang ..... B65D 81/052 220/592.27
2010/0018724 A1 * 1/2010 Cleary ..... A62C 8/005 169/53
2011/0139668 A1 * 6/2011 Baker ..... B65D 81/051 229/87.02
2014/0224699 A1 * 8/2014 Smith ..... B65D 81/052 206/522
2015/0266646 A1 * 9/2015 Feng ..... B65D 81/075 206/583
2016/0045381 A1 * 2/2016 Spence ..... A61F 17/00 206/570
2016/0137384 A1 * 5/2016 Buelna ..... B65D 81/07 206/583
2020/0191522 A1 6/2020 Searle et al.
2022/0355997 A1 * 11/2022 Kronkright ..... B65D 81/07

* cited by examiner

CONTAINER FOR TRANSPORTING EQUIPMENT FOR SPACE-RELATED APPLICATIONS

CROSS REFERENCES TO RELATED APPLICATIONS

This application is related to and claims priority from the following U.S. patent application. This application claims priority to and the benefit of U.S. Provisional Patent Application No. 63/292,183, filed Dec. 21, 2021, which is incorporated herein by reference in its entirety.

BACKGROUND OF THE INVENTION

1. Field of the Invention

The present invention relates to containers for holding sensitive equipment, and more specifically to containers for holding equipment during transport into space, especially for transport in low-gravity environments.

2. Description of the Prior Art

It is generally known in the prior art to provide climate-controlled containers for satellites and other large space equipment for terrestrial transport. For example, companies such as RUAG manufacture terrestrial transport vessels used to move satellites from production facilities to spaceports. Commonly, terrestrial transport vessels load equipment onto flat beds that are slid inside a cargo vessel for transport. Some examples of terrestrial transport vehicles are able to rotate the equipment during transport, which is most notably used for installation at the launch point.

It is also known to provide containers for transporting objects, such as satellites, into space. For example, D-Orbit's ION Satellite Carrier has been used to transport multiple satellites into space.

Prior art patent documents include the following:

U.S. Patent Publication No. 2020/0191522 for Composite firearm case by inventors Searle et al., filed Nov. 27, 2019 and published Jun. 18, 2020, discloses a protective carrying case for a firearm is disclosed, wherein the protective carrying case includes a top component, a bottom component, and semi-hexagonal ends, wherein the top component and the bottom component are constructed from carbon fiber. The protective carrying case additionally includes a retaining element with vacuum split functionality to retain elements within the case.

U.S. Pat. No. 9,955,763 for Secure portable encasement system by inventors McLean et al., filed Feb. 10, 2017 and issued May 1, 2018, discloses a system for providing securement of a plurality of secure portable encasements including one or more encasements each configured to engage, and subsequently disengage, inseparable interaction with a common docking unit; and one or more common docking units.

U.S. Pat. No. 9,803,956 for Electronic tablet case and firearm holder by inventor Ellingson, filed Jun. 24, 2015 and issued Oct. 31, 2017, discloses an electronic tablet case capable of concealing a firearm. The case is formed from a housing having closeable panels that are hingedly connected, defining an interior and exterior. The exterior of one of the panels includes mounting elements for securing to an electronic tablet. The interior of one panel includes at least one support element for holding a firearm in position. The panels can be secured together by use of a zipper, hook & loop or the like fastener.

U.S. Pat. No. 9,303,950 for Lockable cut-resistant case by inventor Fuller, filed May 11, 2011 and issued Apr. 5, 2016, discloses a light-weight case is provided that is cut-resistant, fire-resistant and/or water-proof and that can be easily locked and fasten to stationary objects. The exterior of the case is substantially cut-resistant, while the interior layers can be layers that are fire-resistant, water-proof, any type of padding or nylon for protecting the objects stored in the case. To protect the case from being stolen, a steel cable is threaded through a hole formed by two concentrically aligned grommets and locked to or around a stationary object. The cases include a Global Positioning System (GPS) transmitter that is able to track the location of the case if the case happens to be lost or stolen. The case can be sized and shaped to hold any type of valuable objects, such as guns, jewelry and money.

U.S. Pat. No. 9,429,389 for Multifunctional cases with locking mechanisms by inventor Brewer, filed Jul. 29, 2015 and issued Aug. 30, 2016, discloses a multifunctional case that can be used for protecting and preventing unauthorized use of different types and sizes of objects, weapons, firearms, or other items. In one embodiment, the multifunctional case includes a first shell and a second shell that is coupled to the first shell. A locking mechanism is coupled to the first shell. An external handle (e.g., handle that is external to the multifunctional case) is coupled to the locking mechanism and causes the locking mechanism to lock and unlock the first and second shells of the multifunctional case based on movement of the handle. The multifunctional case is securely locked and unlocked with no external clips or latches.

U.S. Pat. No. 6,135,277 for Vacuum resealable display/storage case by inventor Armstrong, filed Apr. 10, 1998 and issued Oct. 24, 2000, discloses a portable airtight inner case including a receptacle for having an item stored therein, for example a guitar, a hingedly mounted cover and a perimetric seal to form a fluid seal between the cover and receptacle when the cover is closed. The inner case cover and receptacle are made of a clear rigid plastic. A suction valve or pump opens to the inner case interior to evacuate fluid while a vacuum gauge is provided for measuring the pressure. The inner case bottom wall has a plurality of pockets for having hangers extended therein to hang the case on a wall and stand pockets to have stand parts of a foldable stand extended therein or a stand pivoted to the bottom wall to support the inner case in an inclined condition. A portable outer case has a compartment for containing the inner case.

SUMMARY OF THE INVENTION

The present invention relates to containers for holding sensitive equipment, and more specifically to containers for holding equipment during transport into space, especially for transport in low-gravity environments.

It is an object of this invention to provide a means for transporting large equipment into low-orbit and beyond.

In one embodiment, the present invention is directed to a container for transporting equipment, including a composite shell, wherein an inner surface of the composite shell is lined with a plurality of vacuum rigidizing structures, wherein the plurality of vacuum rigidizing structures each contain a plurality of microbeads.

In another embodiment, the present invention is directed to a system for transporting equipment, comprising a flexible containing device radially divided into a plurality of sections by a plurality of baffle lines, wherein the flexible containing device includes a cinch strap operable to tightly narrow a ring of the flexible containing device, and wherein the plurality of sections are each connected to one or more pump mechanisms operable to add air to or subtract air from the plurality of sections.

These and other aspects of the present invention will become apparent to those skilled in the art after a reading of the following description of the preferred embodiment when considered with the drawings, as they support the claimed invention.

DETAILED DESCRIPTION

Figure 1:
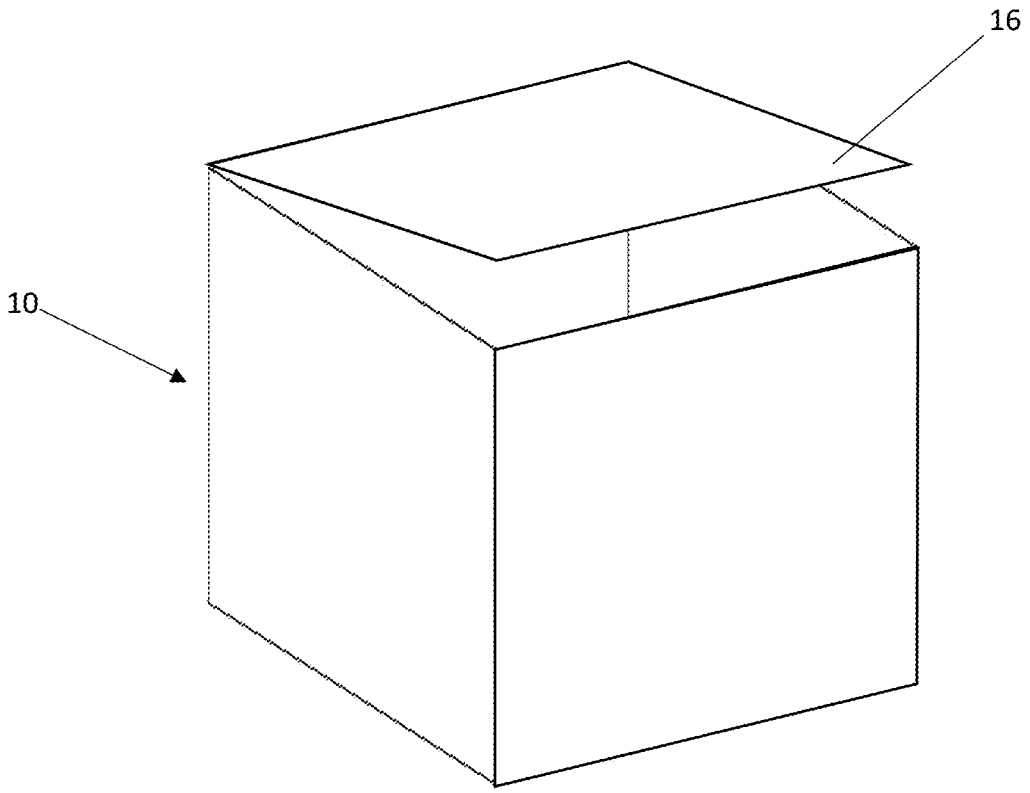
FIG. 1 illustrates is an orthogonal view of a container with a slightly open lid according to one embodiment of the present invention.

The present invention is generally directed to containers for holding sensitive equipment, and more specifically to containers for holding equipment during transport into space, especially for transport in low-gravity environments.

In one embodiment, the present invention is directed to a container for transporting equipment, including a composite shell, wherein an inner surface of the composite shell is lined with a plurality of vacuum rigidizing structures, wherein the plurality of vacuum rigidizing structures each contain a plurality of microbeads.

In another embodiment, the present invention is directed to a system for transporting equipment, comprising a flexible containing device radially divided into a plurality of sections by a plurality of baffle lines, wherein the flexible containing device includes a cinch strap operable to tightly narrow a ring of the flexible containing device, and wherein the plurality of sections are each connected to one or more pump mechanisms operable to add air to or subtract air from the plurality of sections.

None of the prior art discloses secure space-destined cargo containers for transporting satellite equipment or other large, delicate equipment. While containers do exist for transporting satellite equipment on land, these containers, such as those developed by RUAG, most typically involve strapping the equipment to a flat transport bed and either sliding the equipment into a larger cargo container or bringing a cargo container down on top of the flat transport bed and sealing it. These containers are not meant to address the satellite equipment moving around substantially, as the satellite equipment is strapped to a single and typically transported very carefully. However, such a solution only is possible in terrestrial environments, with normal gravity.

Space transport containers offer great potential to increase efficiency and decrease cost for space-related activities. Traditionally, satellites are not repaired and are not built to be repaired. The assumption has been that the cost of sending a repair team and equip into orbit to repair the satellite would often be as costly or more costly than simply building a new satellite and launching it into orbit, while abandoning or scuttling the previous one. However, as the economics of rocket launches change, it has become more practical to repair satellites. This new opportunity brings the additional challenge of actually transporting the repair equipment into space. For example, during rocket launch, large vibrations propagate throughout the rocket, which are easily able to cause massive damage to even engine equipment for the rocket, let alone equipment being carried in the rocket. Unlike on land, low-orbit environments and deep space missions have very low gravity, causing objects within containers to freely float and potentially be damaged. Therefore, there is a growing need for a container that is able to safely contain equipment taken to space, such as for satellite repair.

Referring now to the drawings in general, the illustrations are for the purpose of describing one or more preferred embodiments of the invention and are not intended to limit the invention thereto.

FIG. 1 illustrates is an orthogonal exterior view of a container with a slightly open lid according to one embodiment of the present invention. In one embodiment, the container 10 is a substantially rectangular prism having side walls and a base. In one embodiment, a lid 16 is pivotably attached to a side wall of the container 10. When the lid 16 is in a closed position, the container 10 defines an enclosed, sealed interior space. When the lid 16 is in an open position, as shown in FIG. 1, objects are able to placed into the container 10 or taken out of the container 10.

One of ordinary skill in the art will understand that the shape of the container 10 is not intended to be limited to a rectangular prism. The base of the container 10 is able to take on any number of shapes, including, but not limited to, a circle, a triangle, a rectangle, a pentagon, a hexagon, an octagon, a trapezoid, a rhombus, and/or any other shape. Similarly, the number of side walls of the container 10 and the shape of the side walls of the container are not intended to be limiting. The size of the container 10 is not intended to be limiting. In one embodiment, the container 10 is sized to match individual pieces of equipment. Therefore, smaller containers are able to be produced for smaller pieces of equipment, while larger containers are able to be created for larger pieces of equipment. Similarly, in one embodiment, the container 10 is shaped to match the shape of the equipment. In another embodiment, the shape of the container 10 is adapted to fit the shape of the hull of a spacecraft used to transport the container. Similar to how air cargo containers are adapted to fit the geometry of a cargo bay to limit movement of the containers, in one embodiment, the exterior of the container 10 is adapted to fit the geometry of the spacecraft.

Figure 2A:
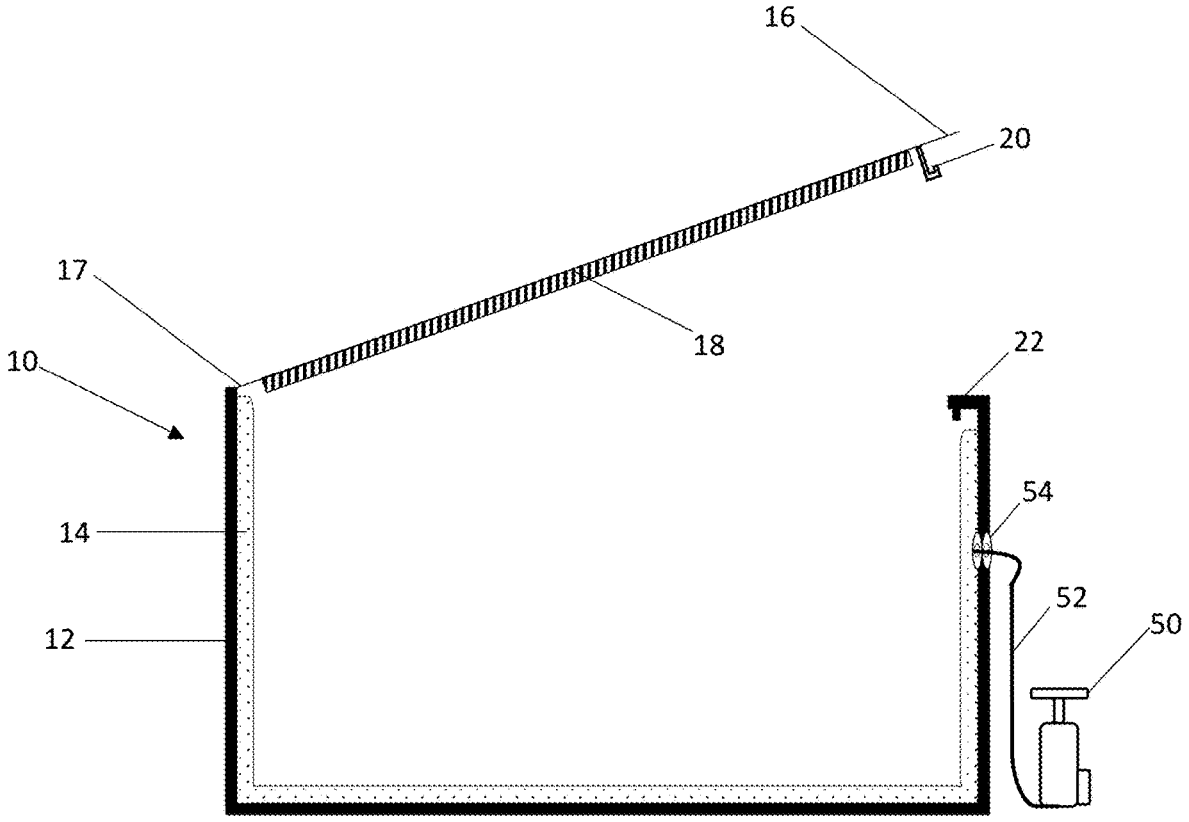
FIG. 2A illustrates a side cross-sectional view of a container with a slightly open lid according to one embodiment of the present invention.

FIG. 2A illustrates a side cross-sectional view of a container with a slightly open lid according to one embodiment of the present invention. In one embodiment, the container 10 includes an outer shell 12. In one embodiment, the outer shell 12 of the container 10 is an integrally formed, continuous piece constituting the outer base and side walls of the container 10. In another embodiment, the outer shell 12 includes a plurality of panels attached (e.g., via an adhesive material, via latches, via welding, etc.) along edges of each of the plurality of panels, such that each side wall of the container 10 includes one or more panels and the base of the container 10 includes one or more panels. In one embodiment, the outer shell 12 is formed from a composite material, including, but not limited to, a carbon fiber reinforced polymer, a glass fiber reinforced plastic, an aramid fiber reinforced polymer (e.g., KEVLAR, TWARON, NOMEX, etc.), and/or a basalt fiber reinforced polymer. In one embodiment, the outer shell 12 is in contact with, is manufactured with, or integrally includes one or more layers for padding, durability, strength, and/or flexibility, including any of the prior mentioned materials. In another embodiment, the outermost layer and the innermost layer are about 0.127 cm (about 0.05 inches) thick. In one embodiment, the middle layer of the outer shell 12 is about 0.635 cm (about 0.25 inches) thick. Examples of carbon fibers able to be used for the outer shell include 1K, 2K, 3K, 6K, 12K, 24K, or 48K carbon fibers. In another embodiment, unidirectional carbon fibers are used in the exterior shell. Hybrid composites which include carbon fibers and high molecular-weight polypropylene, polyethylene, and/or other thermoplastics or thermosets are utilized in another embodiment. In one embodiment, the unidirectional carbon fibers include upcycled shredded carbon fiber, providing increased strength due to the varying fiber orientations in the upcycled plenty, and providing improved sustainability. An example of a hybrid composite is INNEGRA manufactured by INNEGRA TECHNOLOGIES. Carbon fibers are also blended with steel fibers or other metal fibers to form one or more layers of the outer shell 12 in one embodiment of the present invention. In yet another embodiment, any of the above recited materials are utilized in any combination and in any number of layers to form the outer shell 12 of the case. For example, in one embodiment, any component of the case, including a top component, a bottom component, or an interior component, is operable to be constructed from poly-para-phenylene terephthalamide (i.e., KEVLAR), carbon fiber, and/or hybrids or combinations of Kevlar, carbon, and/or natural or synthetic fibers. In one embodiment, the outer shell has similar specification as that of the shell of the case disclosed in U.S. Patent Publication No. 2021/0080224, which is incorporated herein by reference in its entirety. One or more outer surfaces of the outer shell 12 define an outer surface of the container 10, while one or more inner surfaces of the outer shell 12 are oriented toward the enclosed, sealed-interior space of the container 10. In a preferred embodiment, the hard carbon-fiber outer shell transfers vibrations at a lower speed and frequency relative to standard materials used for space-related packaging devices used today, thereby dampening the negative effects of vibrations and g-forces on the materials within the outer shell 12.

The outer shell 12 is operable to be manufactured using any method known in the art, including but not limited to, vacuum molding, vacuum forming, infusion including vacuum infusion, and extrusion.

The one or more inner surfaces of the outer shell 12 are attached to and substantially covered by one or more vacuum rigidizing structures 14 (or VRS systems). The one or more vacuum rigidizing structures 14 are flexible containers containing a plurality of microbeads. Each vacuum rigidizing structure 14 includes at least one vacuum port 54, operable to connect to at least one pump. The at least one pump is able to add air into or withdraw air from the one or more vacuum rigidizing structures 14. When air is withdrawn from the vacuum rigidizing structures 14, the volume of the vacuum rigidizing structures 14 decrease and the microbeads within the vacuum rigidizing structures 14 become compactified to become better able to conform to any object applying pressure to the vacuum rigidizing structures 14. Once the beads are more compact, the equipment is prevented from easily moving around and potentially becoming damaged. Furthermore, the beads help to absorb and dampen vibrations, such as those vibrations that occur during launch.

Importantly, the container 10 does not only include a vacuum rigidizing structure 14 covering an inner surface of the base of the container 10. Instead, the container 10 includes at least one vacuum rigidizing structure 14 substantially covering an inner surface of each side wall of the container 10 in addition to substantially covering an inner surface of the base of the container 10. For equipment that is not substantially flat, it is important that the side walls of the container 10 are also able to apply pressure and conform to the equipment, such that the equipment does not roll around during transport, potentially damaging the equipment. Furthermore, if covering the equipment from a greater number of sides helps to reduce vibration of the equipment that often causes damage during transport.

In one embodiment, the inner surfaces of the side walls and base of the container 10 are covered with a single vacuum rigidizing structure, which has a single, unbroken inner chamber containing microbeads. In another embodiment, the inner surface of the side walls and base of the container 10 are covered with a plurality of vacuum rigidizing structures (e.g., one vacuum rigidizing structure on each inner surface of the container 10). In one embodiment, each of the plurality of vacuum rigidizing structures have its own vacuum port 54 able to a connected with a pump 50 via tubing 52, such that the amount of air contained in each vacuum rigidizing structure 14 is able to be adjusted independently. In one embodiment, the vacuum port 54 for each vacuum rigidizing structure is located adjacent to a corresponding port in the outer shell 12, allowing pumps 50 to connected to each vacuum rigidizing structure 14 through the outside of the container 10. This allows the vacuum rigidizing structures 14 to be inflated or deflated even when the container 10 is closed. In another embodiment, a multiplicity of the plurality of vacuum rigidizing structures are connected to a single vacuum port, which is therefore capable of evacuating air from multiple components at once.

In one embodiment, the vacuum rigidizing structures 14 are attached to the outer shell 12 via an adhesive material. In another embodiment, the vacuum rigidizing structures 14 are attached to the outer shell 12 via a plurality of hook and loop materials. In yet another embodiment, the inner surface of the outer shell 12 includes at least one footman loop. Straps (e.g., nylon straps) attached to the outer surface of the vacuum rigidizing structures 14 are threaded through the at least one footman loop attached to the inner surface of the outer shell 12 in order to attach the outer shell 12 to the vacuum rigidizing structures 14. One of ordinary skill in the art will understand that the means of attaching the vacuum rigidizing structures 14 to the outer shell 12 are not intended to be limiting according to the present invention.

As shown in FIG. 2A, in one embodiment, the lid 16 is connected to a side wall of the outer shell 12 of the container 10 by a hinge 17. In one embodiment, the hinge 17 is a living hinge, such that the outer shell 12 and the lid 16 are integrally formed. In another embodiment, the hinge 17 is not a living hinge and it is formed from carbon fiber and/or from a combination of carbon fiber and KEVLAR, as produced by TALON TECHNOLOGY. An end of the lid opposite to that connected to the hinge 17 includes an attachment mechanism 20 (e.g., a hook, a magnet, etc.) operable to connected to a corresponding attachment mechanism 22 extending from a side wall of the outer shell 12 of the container 10. In one embodiment, when the lid 16 is in a closed position the attachment mechanism 20 is matingly attached to the corresponding attachment mechanism 22, such that the lid 16 is locked shut. In one embodiment, the lid 16 is only locked or unlocked upon activation via a key. In one embodiment, an inner surface of the lid 16 is substantially covered by an aerospace-grade foam 18. When the lid 16 is in a closed position, the aerospace-grade foam 18 on the lid 16 is therefore able to gently contact the equipment and provide further protection. In another embodiment, the inner surface of the lid is covered by at least one vacuum rigidizing structure.

Figure 2B:
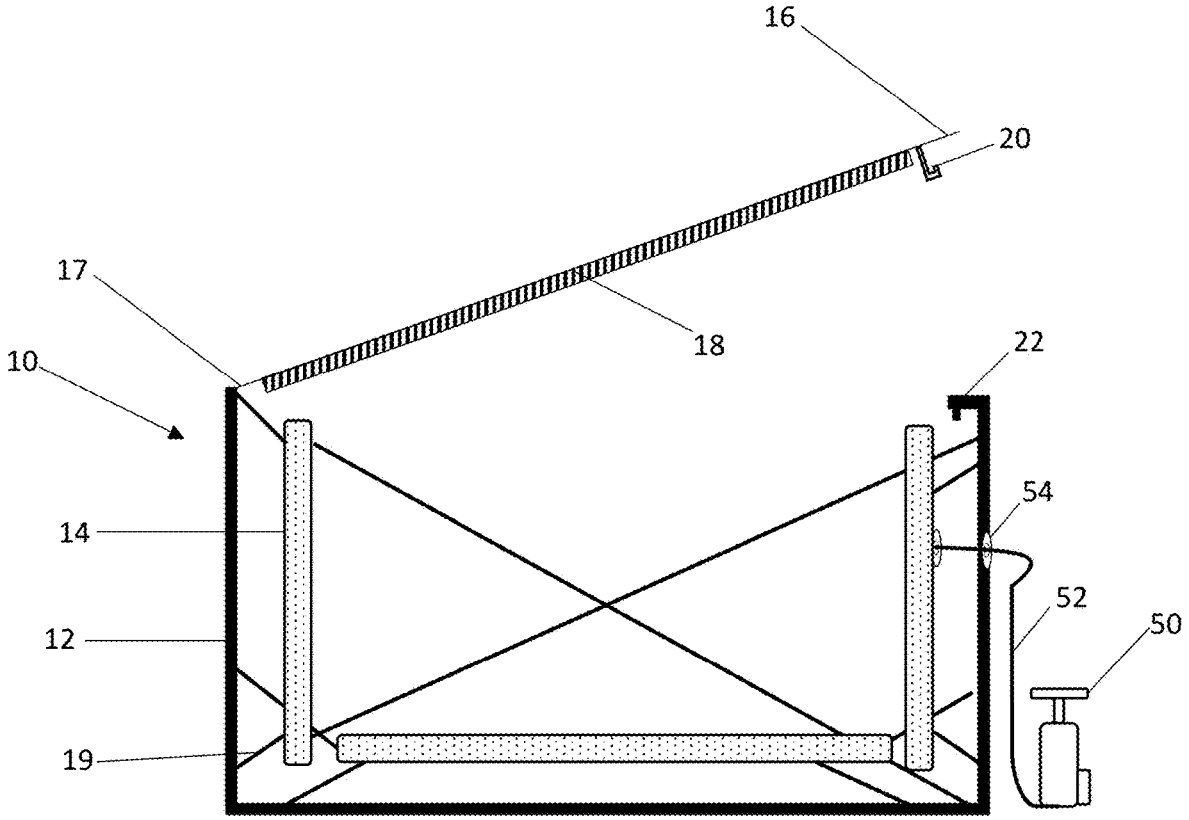
FIG. 2B illustrates a side cross-sectional view of a container with suspended vacuum rigidizing structures according to one embodiment of the present invention.

FIG. 2B illustrates a side cross-sectional view of a container with suspended vacuum rigidizing structures according to one embodiment of the present invention. In one embodiment, vacuum rigidizing structures 14 within an outer shell 12 are suspended within the outer shell 12 by a plurality of straps 19 (e.g., nylon straps). In one embodiment, the plurality straps 19 includes straps attached to an inner surface of the outer shell 12 adjacent to the vacuum rigidizing structure as well as straps attached to at least one other inner surface of the outer shell 12, such that the vacuum rigidizing structure 14 is suspended in mid-air within the container 10. In this embodiment, the straps attached to the adjacent inner surface and the straps attached to the at least one other inner surface apply tensile forces to the vacuum rigidizing structures 14 in opposite directions, thereby allowing the vacuum rigidizing structure 14 to be suspended in mid-air. Therefore, in this embodiment, the straps attached to the vacuum rigidizing structure 14 are able to be pulled tight in order to maintain the vacuum rigidizing structure 14 firmly in place. In another embodiment, only straps attached to an adjacent inner surface of the container 10 are attached to the vacuum rigidizing structure 14. In this embodiment, the tensile force applied by the straps is counteracted by a weight of the vacuum rigidizing structure 14 such that vacuum rigidizing structure 14 is suspended in mid-air. By suspending the vacuum rigidizing structures 14 in mid-air, vibrations affecting the outer shell 12 of the container 10 are less easily translating to the vacuum rigidizing structures 14 within the container 10 and therefore less easily translated to any equipment secured by the vacuum rigidizing structures 14.

Figure 3:
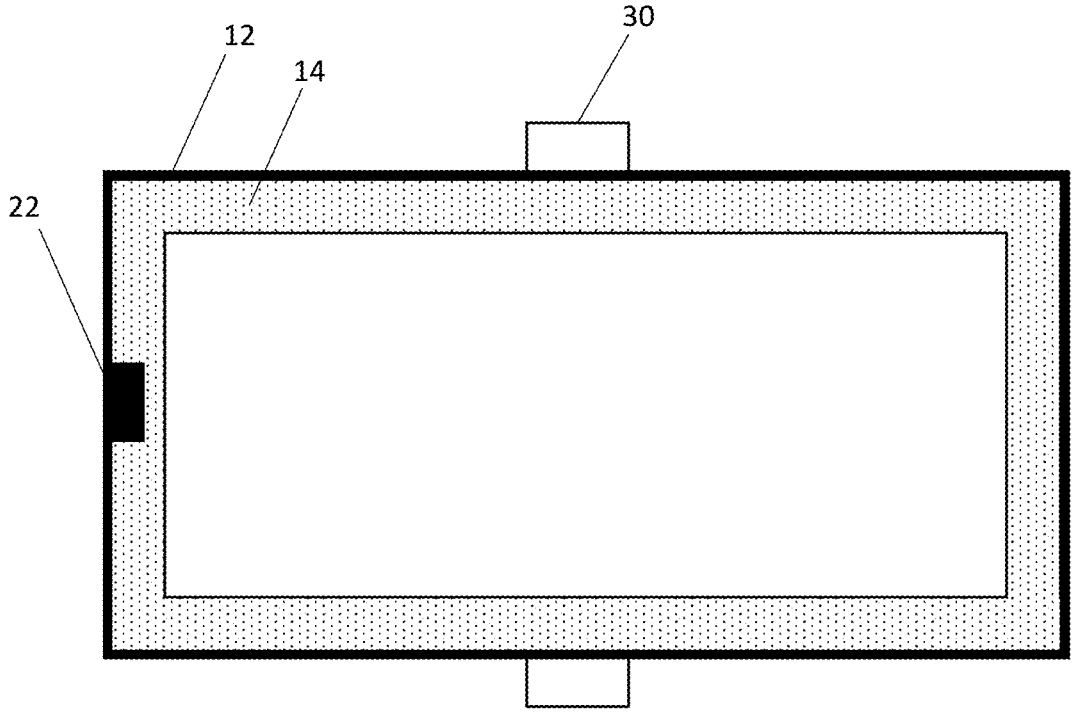
FIG. 3 illustrates a top view of a container with the lid not shown according to one embodiment of the present invention.

FIG. 3 illustrates a top view of a container with the lid not shown according to one embodiment of the present invention. From the top of the container, one is able to see that the inner surface of each side wall of the outer shell 12 of the container is covered by at least one vacuum rigidizing structure 14. In one embodiment, at least one tie-down strap 30 is wrapped around the container when in a closed position, in order to more firmly hold the container closed.

Figure 4:
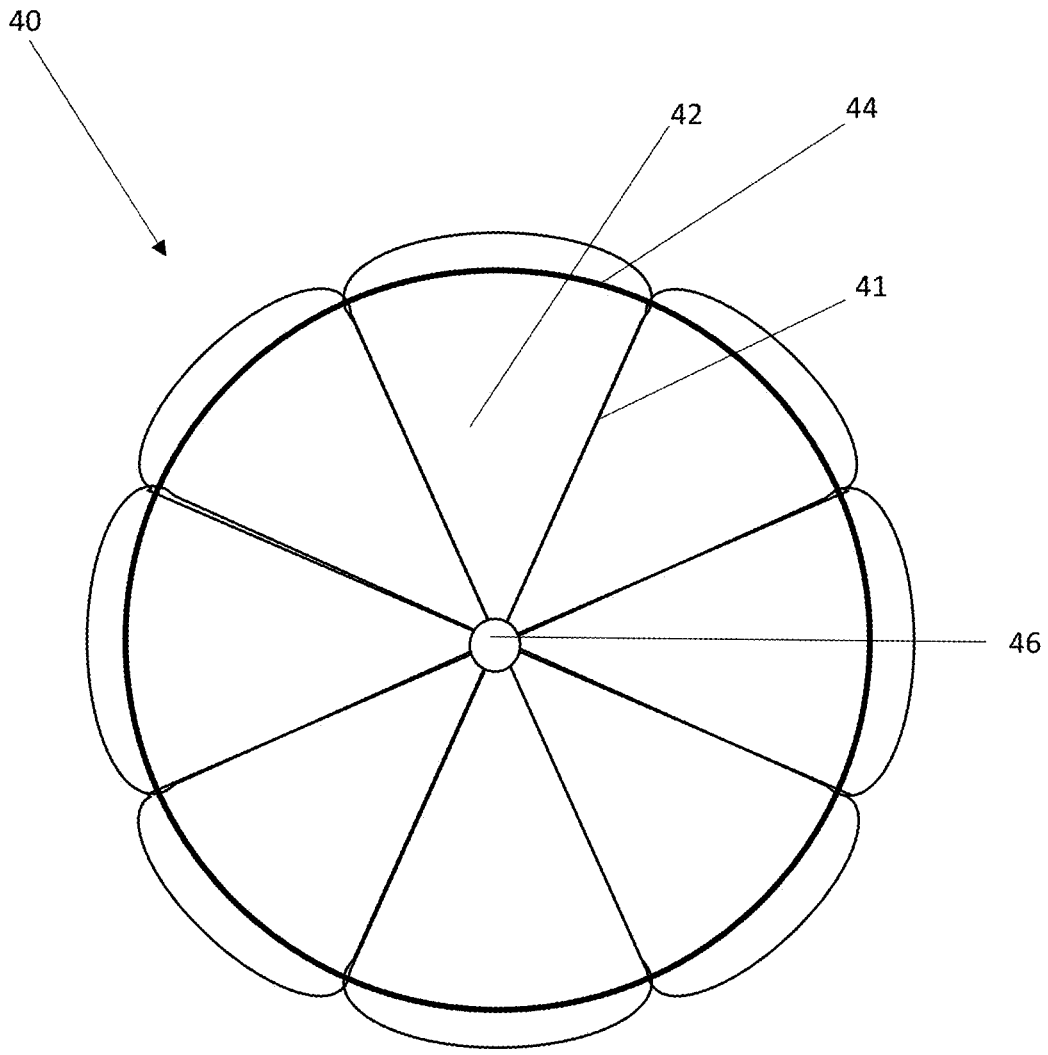
FIG. 4 illustrates a top view of a retractable retention system according to one embodiment of the present invention.

FIG. 4 illustrates a top view of a retractable retention system according to one embodiment of the present invention. Alternatively, in some instances, a container having a hard outer shell is not needed or desirable for transferring equipment. One solution is to provide a retractable retention system 40, as shown in FIG. 4. The retractable retention system 40 includes a vacuum rigidizing system divided into a plurality of sections 42 delineated by a plurality of baffles 41. In one embodiment, the plurality of baffles 41 isolate and seal each of the plurality of sections 42 from one another. Therefore, each of the plurality of sections 42 is an isolated chamber containing microbeads which are unable to flow into the other sections.

The retractable retention system 40 shown in FIG. 4 is a substantially circular object when laid flat, but one of ordinary skill in the art will understand that the shape of the retractable retention system 40 is able to be varied depending on the shape and size of the equipment being transported. Furthermore, FIG. 4 shows baffles 41 extending radially outwardly from a center point of the vacuum rigidizing structure, but one of ordinary skill in the art will understand that the orientation of the baffles 41 along the vacuum rigidizing structure is subject to change. By repositioning the baffles 41, the size, shape, and number of sections 42 are able to be altered to meet the needs of an individual project.

Figure 5:
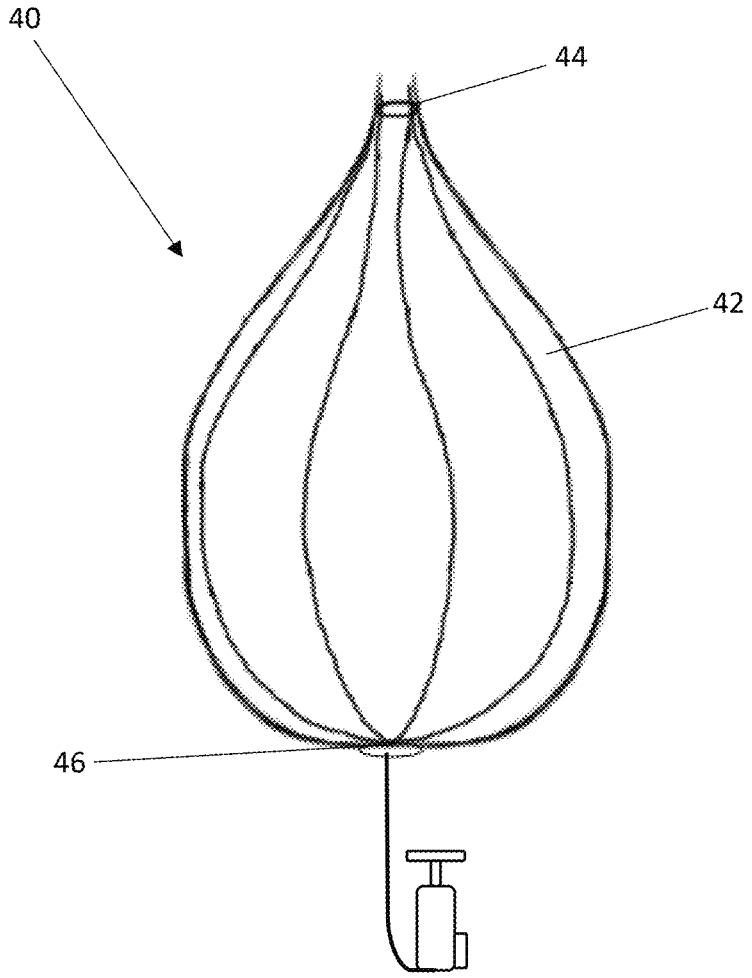
FIG. 5 illustrates a side view of a retractable retention system with a tightened cinch according to one embodiment of the present invention.

In one embodiment, a cinch wire 44 extends around a perimeter of the vacuum rigidizing structure. Activating the cinch wire 44 causes radius of the cinch wire to be reduced, causing a change in the geometry of the retractable retention system 40, as shown in FIG. 5. Methods of activating the cinch wire 44 include, but are not limited to, pulling an exposed portion of the cinch wire 44 or remotely activating the cinch wire 44 to close utilizing a wirelessly connected remote device.

In one embodiment, the retractable retention system 40 includes a common vacuum port 46 connected to each of the plurality of sections 42. The common vacuum port 46 is operable to connect to a pump to inflate or deflate each of the plurality of sections 42. In one embodiment, when air is delivered through the common vacuum port 46, air is distributed approximately evenly between each of the plurality of sections 42. In one embodiment, the common vacuum port 46 includes a single intake port that distributes air to a plurality of exhaust ports open to each of the plurality of sections 42. In another embodiment, each of the plurality of sections 42 of the retractable retention system 40 includes an individual vacuum port in addition to or in lieu of the common vacuum port 46. In one embodiment, the common vacuum 46 and/or the individual vacuum port are able to be connected to at least one extension tubing for connection to at least one pump.

Therefore, the process for transporting equipment involves placing the equipment on the retractable retention system 40, activating the cinch wire 44, such that sections 42 of the retractable retention system 40 are able to contact the base, the sides, and the top of the equipment, adjust the air in each section 42 of the retractable retention system 40 through the common vacuum port 46, and then sealing the top of the retractable retention system 40. Methods of sealing the retractable retention system 40 according to the present invention are not intended to be limiting and include attaching a clip to the retractable retention system 40 proximate to the cinch wire 44 and applying an adhesive substance to the retractable retention system 40 proximate to the cinch wire 44. In one embodiment, the retractable retention system 40 is sealed via heat welding after the cinch wire 44 has been tightened. In another embodiment, an outside surface of a plurality of sections of the retractable retention system 40 include at least one hook and loop fastening strip and/or at least one zipper strip, which are operable to connect to at least one hook and loop fastening strip and/or at least one zipper strip attached to an outside surface of another of the plurality of sections, such that the retractable retention system 40 is able to be sealed. One of ordinary skill in the art will understand that any of the above sealing mechanisms are able to be used alone or in combination with another sealing mechanism.

Figure 6:
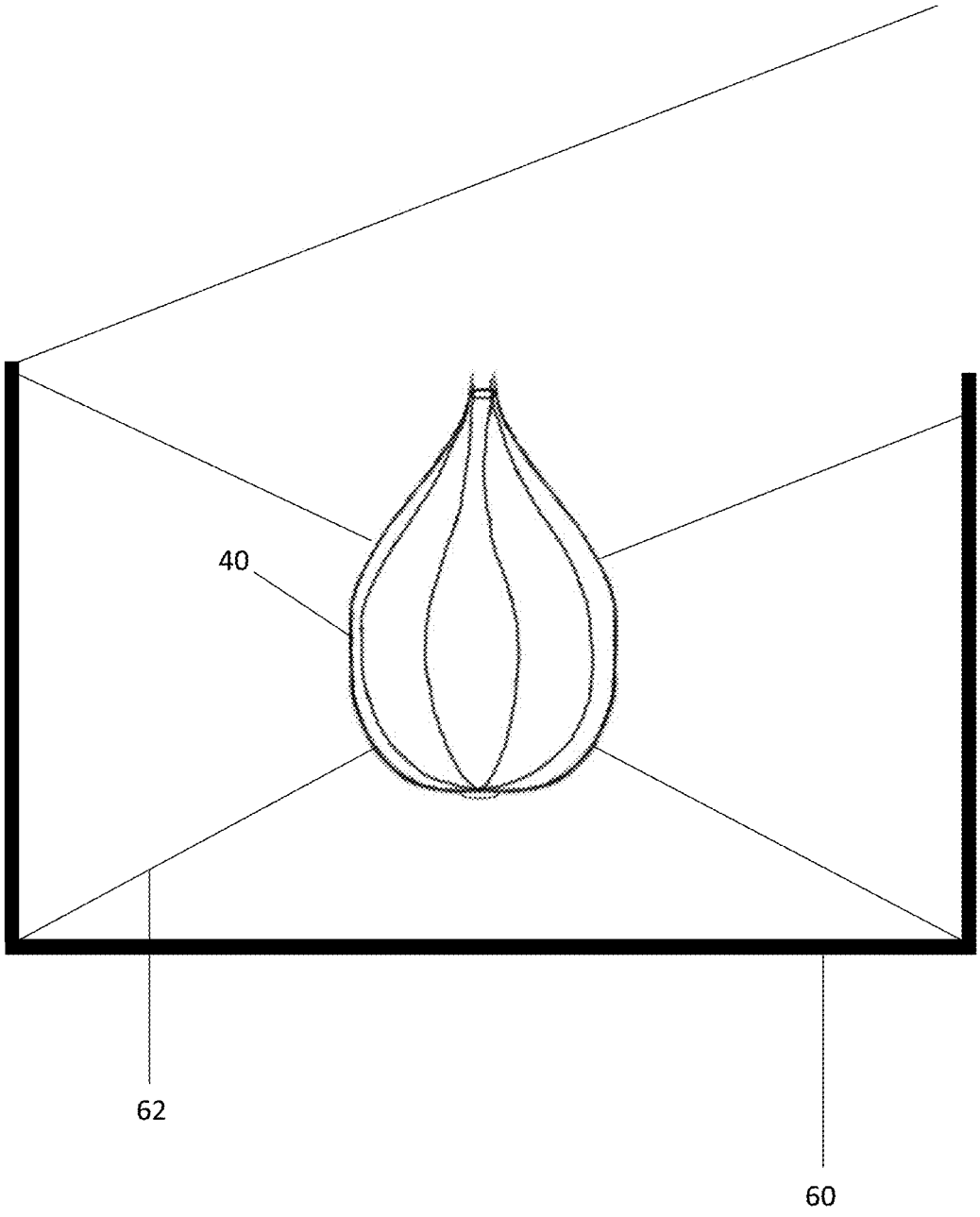
FIG. 6 illustrates a retractable retention system suspended within a hardened case according to one embodiment of the present invention.

FIG. 6 illustrates a retractable retention system suspended within a hardened case according to one embodiment of the present invention. In one embodiment the retractable retention system 40 is suspended within a case 60 by a plurality of cables 62. In one embodiment, the plurality of cables 62 extend from a position proximate to the corners of the case 60 and are retractable, such that the cables are able to be pulled taut to fully suspend the system 40. In one embodiment, the cables are tightened using a single external tightening mechanism. In another embodiment, each cable is able to be individually tightened using a plurality of external tightening mechanisms. The use of the cables 62 allows impacts on the retractable retention system 40 to be dampened, reducing the likelihood of harm to equipment within the retractable retention system 40.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A container for transporting equipment, comprising:

a composite shell, including a plurality of side walls and a base, defining an interior chamber; and at least one vacuum rigidizing structure, wherein the at least one vacuum rigidizing structure is attached to at least one interior surface of the composite shell by at least one strap;

wherein the at least one vacuum rigidizing structure is divided into a plurality of sections delineated by a plurality of baffles;

wherein the tension of the at least one strap is adjustable via a single external tightening mechanism, such that the at least one vacuum rigidizing structure is able to be suspended within the interior chamber;

wherein at least one vacuum suction line is attached to each of the at least one vacuum rigidizing structure via an intake port;

wherein the at least one vacuum suction line is attached to at least one pump operable to add air into or evacuate the air from the at least one vacuum rigidizing structure; and wherein the intake port distributes the air to a plurality of exhaust ports open to each of the plurality of sections.

2. The container of claim 1, wherein the composite shell includes carbon fiber reinforced plastic.

3. The container of claim 1, wherein the at least one vacuum rigidizing structure is filled with a plurality of microbeads.

4. The container of claim 1, wherein the at least one vacuum suction line extends through at least one port defined in a side wall of the composite shell, and wherein the at least one vacuum suction line is configured to connect with the at least one pump outside of the composite shell.

5. The container of claim 1, wherein the container is configured to hold satellite equipment.

6. The container of claim 1, wherein the composite shell includes a lid configured to sealingly close the container.

7. A container for transporting equipment, comprising:

a composite shell, including a plurality of side walls and a base, defining an interior chamber;

at least one vacuum rigidizing structure, wherein the at least one vacuum rigidizing structure is attached to at least one interior surface of the composite shell by at least one strap; and a lid configured to sealingly close the container;

wherein the at least one strap suspends the at least one vacuum rigidizing structure within the interior chamber;

wherein the at least one vacuum rigidizing structure is divided into a plurality of sections delineated by a plurality of baffles;

wherein at least one vacuum suction line is attached to each of the at least one vacuum rigidizing structure via an intake port;

wherein the at least one vacuum suction line is attached to at least one pump operable to add air into or evacuate the air from the at least one vacuum rigidizing structure; and wherein the intake port distributes the air to a plurality of exhaust ports open to each of the plurality of sections.

8. The container of claim 7, wherein the composite shell includes carbon fiber reinforced plastic.

9. The container of claim 7, wherein the at least one vacuum rigidizing structure is filled with a plurality of microbeads.

10. The container of claim 7, wherein the container is configured to hold satellite equipment.

11. The container of claim 7, further comprising a cinch wire operable to extend around a perimeter of the at least one vacuum rigidizing structure, wherein activation of the cinch wire causes a radius of the cinch wire to be reduced, and a change in geometry of the at least one vacuum rigidizing structure.

* * * * *